United States Patent [19]

Wankel

[11] Patent Number: 4,714,417

[45] Date of Patent: Dec. 22, 1987

[54] INTERNAL AXIS SINGLE-ROTATION MACHINE WITH INTERMESHING INTERNAL AND EXTERNAL ROTORS

[76] Inventor: Felix Wankel, Eichwaldstrasse 54, D-8990 Lindau, Fed. Rep. of Germany

[21] Appl. No.: 743,786

[22] Filed: Jun. 12, 1985

[30] Foreign Application Priority Data

Jun. 12, 1984 [CH] Switzerland ..... 2822/84

[51] Int. Cl.[4] ..... F01C 21/12; F01C 1/10; F04C 15/02; F04C 2/00

[52] U.S. Cl. ..... 418/159; 418/166

[58] Field of Search ..... 418/166–171, 418/159; 417/440

[56] References Cited

U.S. PATENT DOCUMENTS

| | | | |
|---|---|---|---|
| 1,292,091 | 1/1919 | Schirmer | 418/166 |
| 1,341,846 | 6/1920 | Gollings | 418/167 |
| 1,964,330 | 6/1934 | Pitt | 418/168 |
| 2,956,506 | 10/1960 | Brundage | 418/168 |
| 2,965,039 | 12/1960 | Morita | 418/166 |
| 3,029,738 | 4/1962 | Clar | 418/168 |
| 3,108,739 | 10/1963 | Nilsson | 418/201 |
| 3,151,806 | 10/1964 | Whitfield | 418/159 |

FOREIGN PATENT DOCUMENTS

| | | | |
|---|---|---|---|
| 2456252 | 6/1976 | Fed. Rep. of Germany . | |
| 652335 | 3/1979 | U.S.S.R. | 418/168 |
| 673745 | 7/1979 | U.S.S.R. | 418/171 |

OTHER PUBLICATIONS

Hill, Myron F., *Kinematics of Gerotors*, The Peter Reilly Company, (1927), pp. 31–38.

*Primary Examiner*—Carlton R. Croyle
*Assistant Examiner*—Jane E. Obee
*Attorney, Agent, or Firm*—Toren, McGeady & Associates

[57] ABSTRACT

An internal axis single-rotation machine, wherein an external rotor and an internal rotor are mounted for intermeshing rotation about their own centers of gravity at different angular velocities within a casing and wherein two pairs of radially external sealing corner areas on the internal rotor kinematically describe internal lateral faces which define recesses in the external rotor and wherein internal sealing corner areas on the external rotor kinematically describe external peripheral faces on the internal rotor, the rotors being arranged in cooperating rotative relationship such that a meshing gear-like contact is maintained between internal lateral faces of the external rotor and lateral faces of the internal rotor.

2 Claims, 18 Drawing Figures

40
41

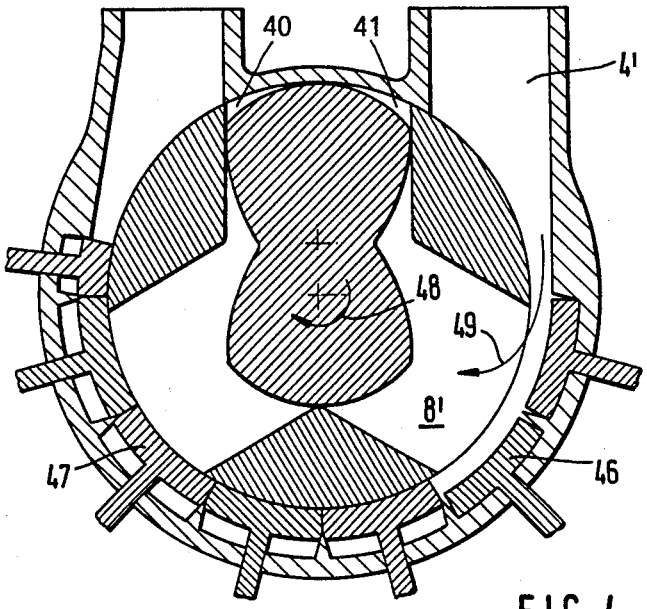
FIG. 4
FIG. 5
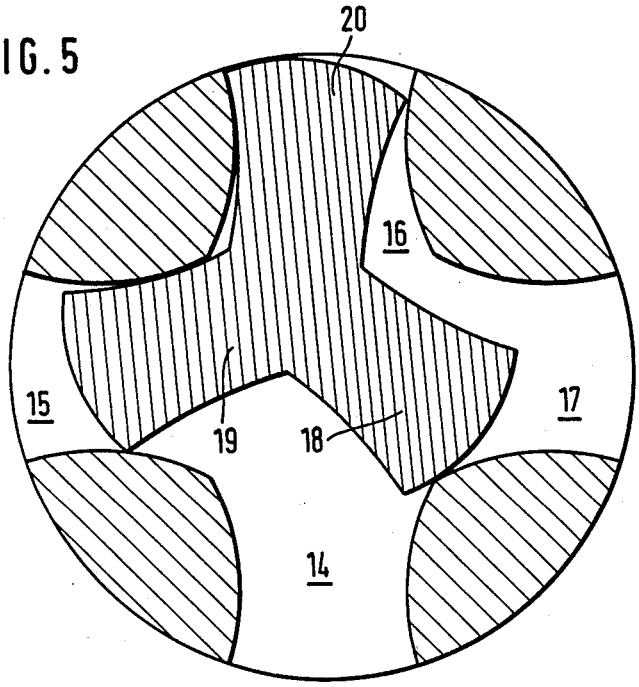

INTERNAL AXIS SINGLE-ROTATION MACHINE WITH INTERMESHING INTERNAL AND EXTERNAL ROTORS

The present invention relates generally to internal axis single-rotation machines and more particularly to machines of the type comprising an internal rotor and an external rotor mounted for intermeshing rotation about their own centers of gravity at uniform angular velocities within a casing which surrounds the rotors.

In the existing literature, a book "Einteilung der Rotations-Kolbenmaschinen" (1963, Deutsche Verlags-Anstalt GmbH Stuttgart) or "Rotary Piston Machine" (London, Iliffe, 1965) by the Applicant of the present application shows numerous structural arrangements for internal axis rotary piston machines, wherein a special design which is a single-rotation machine is involved. The external rotor rotating about a fixed axis may itself control the inflow and outflow ports in the machine casing of this type of device so that internal compression is possible without requiring any additional means. A machine of this type is known, for example, in the prior art from DOS No. 2,456,252. In this type of device, a bead-like profiling of the internal rotor of the machine is kinematically produced by internal corner areas of the external area. Machines of this type will have dead spaces, due to the fact that, when the profiling of the internal rotor moves into recesses of the external rotor, it will not displace the complete contents or volume of the recesses because the profiling will not extend to the outer periphery of the rotor. Thus, when the machine is constructed as a compressor, compressed gas will be fed back to the suction side of the machine. Any reduction in the size of such dead spaces will lead to mechanical weakening of the external rotor and the result is that it is not capable of being loaded at high rotational speeds.

Accordingly, the present invention is directed toward providing an improved machine of the type described, wherein, due to the shape of its rotors, there may be achieved a higher drive throughput relative to its structural volume, as well as a reduction of dead spaces, while permitting high rotational speeds for the rotors.

SUMMARY OF THE INVENTION

Briefly, the present invention may be described as an internal axis single-rotation machine comprising a casing having an internal rotor and an external rotor mounted therein for rotation about their own centers of gravity at uniform angular velocities. The peripheries of the cross-sectional configurations of the rotors are such that the internal rotor is formed to define two pairs of radially external sealing points, external peripheral faces and lateral faces. The cross-sectional configuration of the external rotor is such that the periphery of the cross-sectional configuration thereof defines internal sealing points and includes lateral faces which define recesses. During the relative rotation of the internal and external rotors, their arrangement is such that a cooperating rotative relationship is developed, wherein the two pairs of radially external sealing points of the internal rotor kinematically describe the internal lateral faces of the external rotor and the internal sealing points of the external rotor kinematically describe the external peripheral faces of the internal rotor. Furthermore, the cooperating rotative relationship between the rotors is such that a meshing, gear-like contact exists between the internal lateral faces of the external rotor and the lateral faces of the internal rotor.

As a result of the invention, there is developed a cross-sectional shaping of the rotors which will permit high rotational speeds even though, for the purpose of achieving very small dead spaces, parts of the internal rotor may move up to the outer periphery of the external rotor and even beyond it. Moreover, in accordance with the machine of the invention, surprisingly large working spaces are developed taken in proportion to the overall dimensions of the machine.

The lateral faces of the external rotor defining the internal working spaces preferably are formed with a flat or linear configuration and the internal lateral faces may be arranged oppositely juxtaposed to one another so that they may advantageously extend parallel to each other. As a result, large cross-sectional areas of the working spaces and large control ports on the external rotor may be obtained.

The external corner areas of the internal rotor and the internal corner areas of the external rotor are advantageously formed with a rounded configuration having a constant or variable cross-sectional curvature.

In order to produce large working spaces, the corner areas of the external rotor are located so as to extend radially inwardly to a considerable extent so that they may be in close proximity to the shaft thereof.

The machine of the invention is formed to develop a transmission ratio between the internal and the external rotors which may be 2:1, 3:2, 4:3 or some other appropriate ratio.

In accordance with an advantageous development of the invention, at least one adjustable wall portion is provided on the inside of the casing along which the periphery of the external rotor moves in order to permit control of the discharge rate and/or discharge pressure of the machine. Such an arrangement varies the time of the inflow, and, consequently, the size of the admission and/or the time of the outflow, and, consequently, the pressure level of the transfer into the pressure pipe.

The invention permits development of cross-sectional shapes for the external and internal rotors which allow very high rotational speeds by virtue of enabling development of very high strengths for the rotors. Cooling ducts may be provided so that the machine may be driven by hot exhaust gases. It will be apparent that in the case of a corresponding structure of a machine in accordance with the invention, it may also be constructed to be utilized as an internal combustion engine. The very high rotational speeds possible for a machine structured in accordance with the invention indicates that it may be appropriate for utilization of a mounting and an axial lateral sealing of the type, which is described in U.S. Pat. No. 4,540,356 which is in the name of the applicant of the present application. The essential feature of a bearing described in this prior art publication involves the mounting of the ring bearing of the external rotor, which surrounds the internal rotor shaft, on a few rollers instead of utilizing conventional anti-friction bearings.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DESCRIPTION OF THE DRAWINGS

In the drawings:

FIG. 4 is a schematic sectional view of another embodiment of the invention having means for varying the discharge rate and/or the internal compression;

FIG. 5 is a sectional view of a further embodiment of the invention having a different speed ratio from the embodiment shown in FIGS. 1 and 2;

DETAILED DESCRIPTION OF THE PREFERRED EMBODIMENTS

Figure 1:
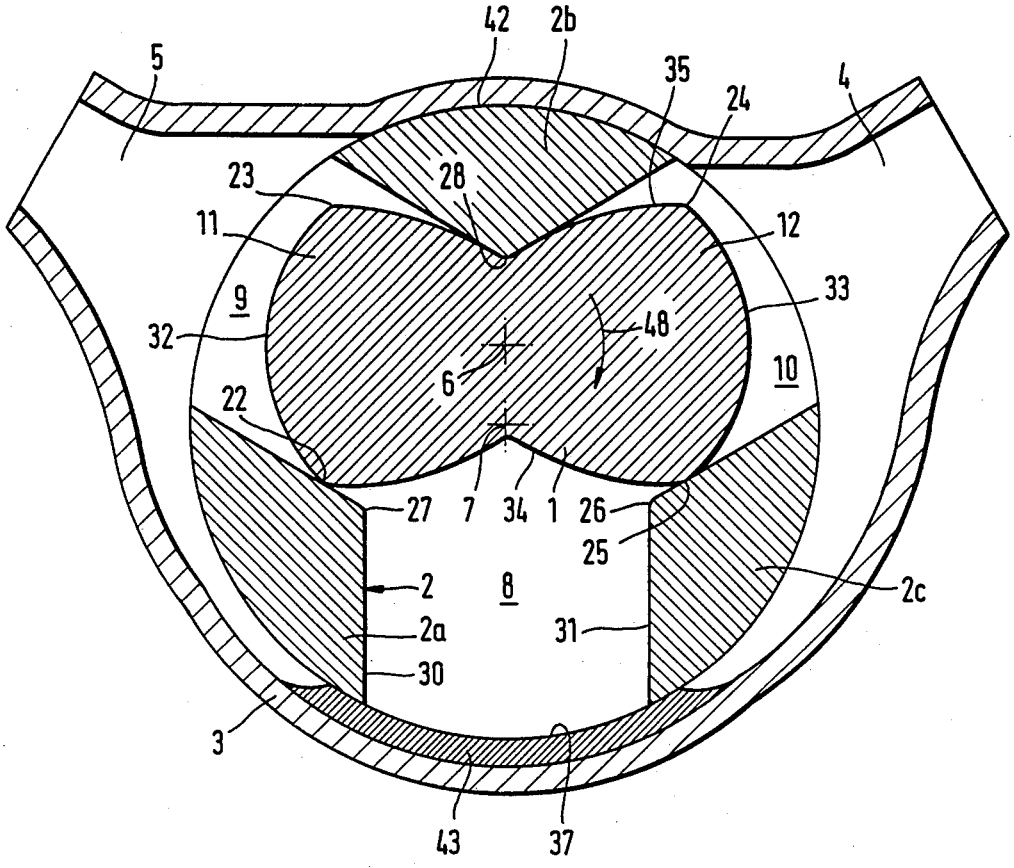
FIG. 1 is a schematic sectional view showing a first embodiment of the invention.
Figure 2:
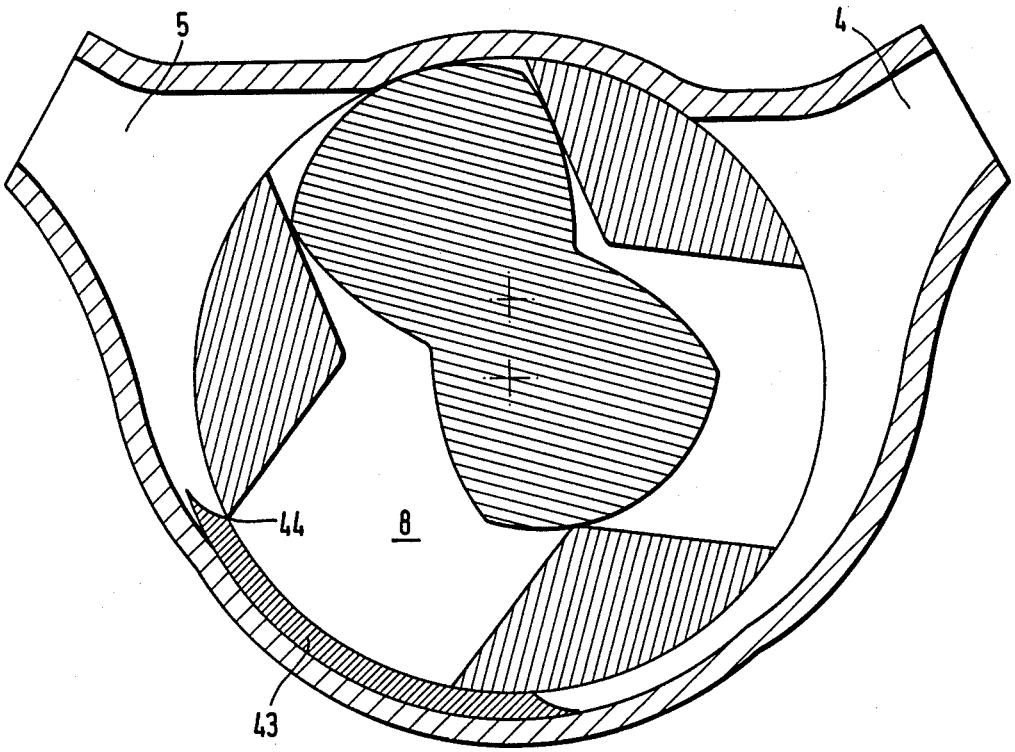
FIG. 2 is a schematic sectional view of the embodiment of FIG. 1, with the rotors thereof shown in a different position.

Referring now to the drawings and more particularly to FIGS. 1 and 2, wherein there is shown a first embodiment of a machine in accordance with the invention, there is depicted an internal axis single-rotation machine having three main parts which comprise an internal rotor 1, an external rotor 2 and a casing 3 surrounding or enclosing therein the rotors 1 and 2. The casing 3 is constructed so as to define an inflow port 4 and an outflow port 5 and the machine shown may be utilized with different functioning parameters, which will determine whether the inflow port 4 is a suction port or an inflow port for fuel.

The external rotor 2 is composed of three rigidly interconnected rotor parts 2*a*, 2*b* and 2*c*. As will be seen from the drawings, the rotor parts 2*a*, 2*b* and 2*c* are formed with limiting faces or axially extending surfaces which run parallel to the rotational axes of the rotors and with end faces or terminal limiting faces which extend at right angles to the rotational axes.

Both the rotors 1 and 2 rotate about fixed axes 6, 7 which are spaced from one another.

Each of the rotor parts 2*a*, 2*b*, 2*c* is formed with internal lateral faces 30, 31 which define therebetween recesses 8, 9 and 10. Furthermore, each of the external rotor parts 2*a*, 2*b*, 2*c* is shaped to define internal sealing points or corner areas 26, 27, 28. The internal rotor 1 is essentially formed to comprise two internal rotor parts or lobes 11 and 12, each of which define, respectively, external peripheral faces 32 and 33 and the internal rotor 1 is also formed to have defined on the periphery of the cross-sectional configuration thereof two pairs or radially external sealing points or corner areas 22, 23 and 24, 25.

The speed ratio between the internal and the external rotor is 3:2 corresponding to the ratio between the number of recesses 8, 9, 10 defined in the external rotor forming the working spaces of the machine and the number of internal rotor lobes 11, 12 extending away from the axis 6.

Figures 3A, 3B, 3C, 3D, 3E, 3F, 3G, 3H, 3I, 3J, 3K, 3L:
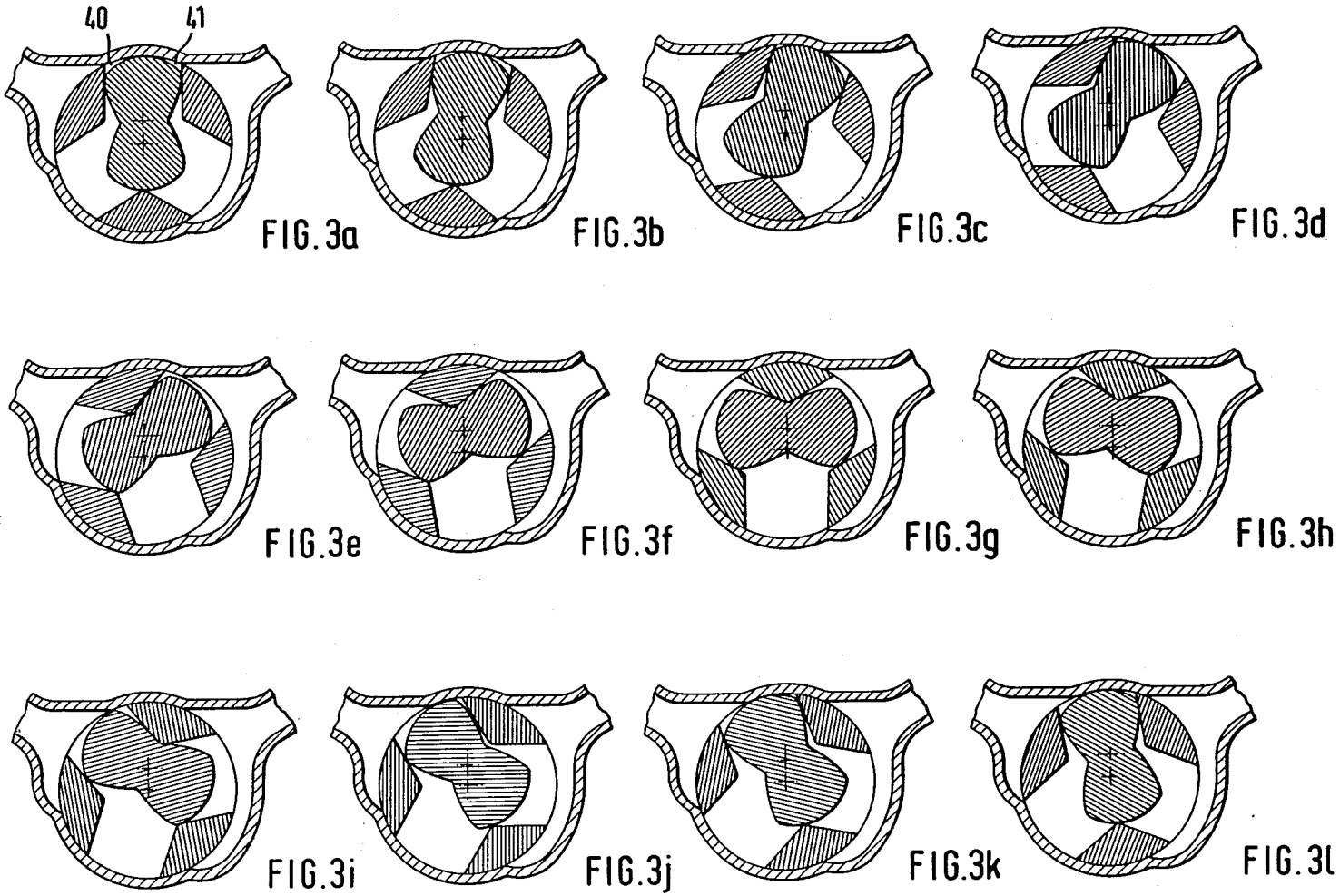
FIGS. 3(*a*)–3(*l*) are a series of cross-sectional schematic views of the embodiment of FIGS. 1 and 2, without variable internal compression showing in succession various rotations positions of the rotors.

As previously indicated, the internal rotor 1 and the external rotor 2 are arranged in a cooperating rotative relationship and the sequence of movement of the two rotors 1 and 2 relative to each other and relative to the machine casing 3 is depicted in FIG. 3, wherein various individual positions of the rotors 1, 2 are shown in succession from (*a*) to (*l*). An uninterrupted seal between the internal and external rotors results from the fact that, during their relative movement, the rotors reciprocally describe their shape. The four external corner areas 22–25 of the internal rotor and the three internal corner areas 26, 27, 28 of the external rotor are used for describing a curve. With the given speed ratio between the two rotors, the corner areas of the internal rotor move along the inner or internal lateral faces 30, 31 of the external rotor or describe the same, and the internal corner areas 26, 27, 28 of the external rotor move along the external peripheral faces 32, 33 of the internal rotor or describe the same. This is illustrated by the positions of movement shown in FIG. 3.

As will be seen in FIG. 1, the internal rotor is also formed with lateral faces 34, 35 and, during the relative rotation between the rotors, a seal is developed between the internal lateral faces 30, 31 of the external rotor and the lateral faces 34, 35 of the internal rotor, which results from a tooth profile contact or gear-like meshing relationship which is produced between the rotors.

The corner areas or sealing points 22–28 of the two rotors are preferably formed with a rounded configuration instead of being shaped with a sharp-edged profile. Thus, the rounding on the other rotor produces an equidistant to the center of curvature of the rounded portion.

As will be gathered from the rotational position shown in FIG. 1, the internal corner area or sealing point 28 of the external rotor 2 is relatively close to the internal rotor axis, as is shown by a comparison with the prior art DOS No. 2,456,252. This leads to an extremely large cross-section of the space between the internal lateral faces 30, 31 of the external rotor, the lateral face 34 of the internal rotor and inner casing surfaces 37, shown in FIG. 1, so that the throughput volume of the machine is particularly large as compared with its size. In the case of a size of, for example, 1.35 $dm^3$, the throughput volume is, for example, 1 $dm^3$.

In the embodiment shown in FIG. 1, the internal lateral faces 30, 31 of the external rotor extend parallel to each other so that each opening of the recesses 8, 9, 10 of the external rotor, which moves past the casing openings at a very high speed is correspondingly advantageously large. This opening cross-section of the external rotor recesses is also advantageously large in other embodiments to be described hereinafter. For example, in the embodiment according to FIG. 7, the internal lateral faces of the external rotor, which taper slightly in the radially outward direction, also define relatively large recess openings.

Despite this particularly large external opening cross-section for the recesses 8, 9, 10 of the external rotor, the particularly large working volume between the internal lateral faces of the internal rotor is almost completely displaced into the recesses 8, 9, 10 during the movement of the internal rotor, as is shown by the rotation position according to FIG. 3(*a*). Thus, there is virtually no dead space which, when the machine is constructed as a compressor, is passed from the discharge port 5 back to the suction port 4. Such dead space is indicated by reference numerals 40 and 41 in FIG. 3(*a*). The negative effect of this dead space can be ignored, not only because it is particularly small, but because the medium compressed therein provides power, because it acts on the rotors in the rotation direction, as shown in FIG. 3(*a*).

In the embodiment shown, the external peripheral faces 32, 33 of the internal rotor move up to the external periphery of the external rotor so that the dead space results from the different curvature of the peripheral surface of the internal rotor and the peripheral surface of the external rotor. However, as the external peripheral surface 32, 33 of the internal rotor can only assume responsibility for sealing on passing the sealing area 32 between the two casing ports 4, 5, it is possible for the two peripheral surfaces 32, 33 to move beyond the periphery of the external rotor.

The sealing between the external rotor 2 and the inner casing wall on the side of the casing diametrically facing the sealing area 42 between ports 4, 5 takes place by means of a peripherally adjustable wall portion 43, so that the internal compression of the machine is variable starting from zero. FIG. 1 shows wall portion 43 in a position leading to no internal compression, while, in the position according to FIG. 2, internal compression takes place up to the represented rotation position until the working space 8 opens, through the trailing edge 44 of the external rotor moving away from wall portion 43. An actuating member (not shown) extending outwards through a slot in the casing wall is used for the peripheral adjustment of wall portion 43. Through the adjustment of wall portion 43, starting from the position according to FIG. 1 in the direction towards the inflow port 4, it is also possible to modify the throughput volume, because, in this way, there is a reduction in the angular range of the external rotor rotation within which medium can flow into the increasingly enlarged working space 8 between the two rotors.

FIG. 4 shows another embodiment for the construction employing means for varying the throughput volume and/or the internal compression of the machine which comprise a plurality of peripherally juxtaposed, arcuate radial slides 46, 47 on the inflow and outflow sides of the machine when the rotors are rotated in the direction of arrow 48. The inflow-side radial slides vary the size of the arc area connected to the inflow port 4' through which there is an inflow in the direction of arrow 49 into the working space 8' enclosed by the two rotors. FIG. 4 shows two inflow-side radial slides 46 in the radial outer position, while the radial slides following the same in the rotation direction have their radial innermost position so that, on operating the machine as a compressor, a maximum internal compression is achieved. The strength of the internal compression can be varied in a stepwise manner in the embodiment according to FIG. 4, corresponding to the number of radial slides 47 retracted radially outwards from the represented position.

It is obvious that means such as the elements 43, 46, 47 for varying the discharge rate and/or the internal compression can be used on any machine where there is an external rotor rotating about a fixed axis and whose recesses forming radially open working spaces move past casing openings.

In the embodiment depicted in FIG. 5, there is shown a machine having a speed ratio of the rotors which is different from the speed ratio of the machine shown in FIGS. 1 and 2. As previously indicated, the embodiment of FIGS. 1 and 2 has a speed ratio of 3:2. In the embodiment according to FIG. 5, this ratio is 4:3. This ratio corresponds to four recesses 14, 15, 16 and 17 and three parts 18, 19 and 20 of the internal rotor moving into and then out of the recesses repeatedly, as is clearly shown in FIG. 5.

Figure 6:
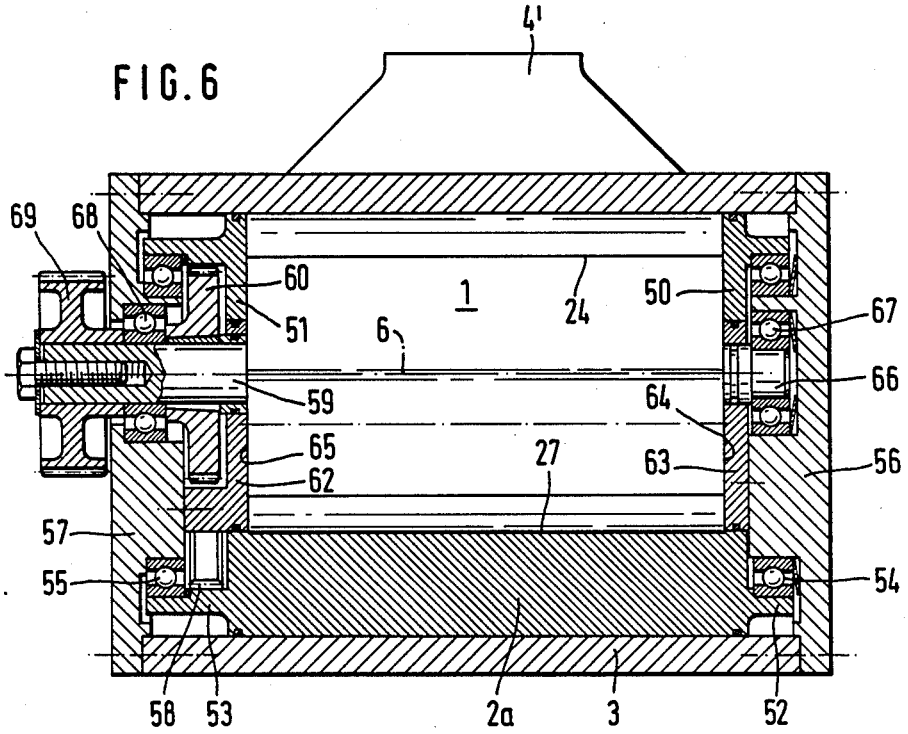
FIG. 6 is a longitudinal sectional view showing a further embodiment of the invention which comprises a machine without internal compression.
Figure 7:
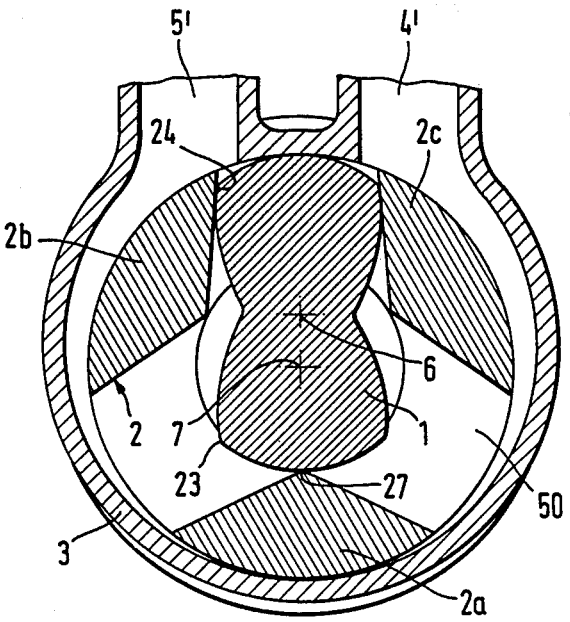
FIG. 7 is a radial sectional view of the embodiment shown in FIG. 6.

FIGS. 6 and 7 show the possible appearance of a machine according to the invention with FIG. 7 being an axial cross-sectional view. The parts of the machine already described relative to FIG. 1 are given the same reference numerals in FIGS. 6 and 7.

Parts *2a, 2b, 2c* of the external rotor are rigidly interconnected at the two axial ends of the rotor by side plates 50, 51. A hub 52 or 53 projects axially outwards from these side plates and, by means thereof, the external rotor is mounted by means of a large diameter ball bearing 54 or 55 on the casing side on plates 56, 57. In the case of high rotational speeds, there are extremely high running speeds of the rolling elements on this bearing, and this can lead to premature wear, so that the use of the aforementioned construction according to EP-A-0,087,747 of the same applicant is recommended.

On the driving or driven side of the machine, the hub 53 of the external rotor has an internal toothing system 58, which meshes with a gear 60 fixed to the shaft journal 59 of the internal rotor 1. This driving connection is recommended for an exact running of both rotors with respect to one another, so that an optimum gap sealing between the two rotors always exists, although the tooth profile-like contact between the lateral faces of both rotors could make the additional gear train 58, 60 superfluous.

The side plates 50, 51 of the external rotor surround circular, lateral sealing plates 62, 63, which are screwed to the casing plates 57, 56 and with a sealing gap spacing are adjacent to the end faces 64, 65 of the internal rotor. These sealing plates also surround the two shaft journals 59, 66 of the internal rotor. Correspondingly, the external bearings of the external rotor always surround the anti-friction bearings 67, 68 mounting the shaft journals 59, 66.

Gear 69 fixed to the shaft journal 59 of the internal rotor which projects laterally over casing plate 57 is either used for driving the machine, when the latter is used as a blower or compressor, or as a driven gear, when the machine is used as an engine or a driver and is driven by an inflowing medium, such as, e.g., the exhaust gas of an internal combustion engine.

Thus, in accordance with the present invention, there is provided a machine, wherein the internal rotor of the single-rotation machine has pairs of external corner areas which, in each case, describe internal lateral faces of the external rotor recesses, while internal corner areas of the external rotor describe internal rotor peripheral faces. There is also a tooth profile-like contact between the inner lateral faces of the external rotor and the lateral faces of the internal rotor, so that the two rotors are sealed against one another. The external rotor recesses are open with unchanged widths in the radial direction and their openings move past the inflow and outflow ports of the machine casing, so that these are controlled. For varying the inflow quantity and/or the internal compression, a wall portion is provided between the outer periphery of the external rotor and the casing inner wall, which is peripherally adjustable from the outside. As a result of the cross-sectional shape of its rotors, the machine has a particularly large throughput volume compared with its size, as well as the capability of a high speed loading of its rotors.

While specific embodiments of the invention have been shown and described in detail to illustrate the application of the inventive principles, it will be understood that the invention may be embodied otherwise without departing from such principles.

What is claimed is:

1. An internal axis single-rotation machine comprising:

a casing defining an internal machine volume which is partially enclosed by diametrically facing sealing parts defined by internal wall portions of said casing and having inlet means and outlet means for effecting fluid flow through said internal volume;

an internal rotor and an external rotor having a generally circular outer periphery both mounted within said casing for rotation about their own centers of gravity at different angular velocities;

said internal rotor having a cross-sectional configuration defining a number of lobes having external peripheral faces and lateral faces which meet each other at radially external sealing corner areas;

said external rotor having a cross-sectional configuration defining internal lateral faces defining a number of recesses, which faces meet each other at internal sealing corner areas;

peripheral surface areas defined on said outer periphery of said external rotor arranged to engage with said diametrically facing sealing parts of said casing to maintain a continuous sealing contact therebetween during rotation of said external rotor relative to said casing thereby to prevent fluid flow through said internal volume around the outer periphery of said external rotor;

said internal rotor and said external rotor rotating at angular velocities having a ratio therebetween which corresponds to the ratio between said number of lobes and said number of recesses and being arranged in a cooperating rotating relationship during relative rotation thereof, wherein a continuous sealing engagement between said rotors is maintained in that said radially external sealing corner areas of said internal rotor kinematically describe said internal lateral faces of said external rotor, said internal sealing corner areas of said external rotor kinematically describe said external peripheral faces of said internal rotor, and a meshing gear-like contact is maintained between said internal lateral faces of said external rotor and said laterla faces of said internal rotor, said internal rotor extending to the periphery of said external rotor at certain points during the relative rotation therebetween, with said recesses of said external rotor extending to the periphery of said external rotor to open radially outwardly thereof and moving past said inlet means and said outlet means of said casing;

said internal lateral faces of said external rotor being flat with said internal rotor and said external rotor rotating relative to one another with a speed ratio of 3:2.

2. An internal axis single-rotation machine comprising:

a casing defining an internal machine volume which is partially enclosed by diametrically facing sealing parts defined by internal wall portions of said casing and having inlet means and outlet means for effecting fluid flow through said internal volume;

an internal rotor and an external rotor having a generally circular outer periphery both mounted within said casing for rotation about their own centers of gravity at different angular velocities;

said internal rotor having a cross-sectional configuration defining a number of lobes having external peripheral faces and lateral faces which meet each other at radially external sealing corner areas;

said external rotor having a cross-sectional configuration defining internal lateral faces defining a number of recesses, which faces meet each other at internal sealing corner areas;

peripheral surface areas defined on said outer periphery of said external rotor arranged to engage with said diametrically facing sealing parts of said casing to maintain a continuous sealing contact therebetween during rotation of said external rotor relative to said casing thereby to prevent fluid flow through said internal volume around the outer periphery of said external rotor;

said internal rotor and said external rotor rotating at angular velocities having a ratio therebetween which corresponds to the ratio between said number of lobes and said number of recesses and being arranged in a cooperating rotation relationship during relative rotation thereof, wherein a continuous sealing engagement between said rotors is maintained in that said radially extending sealing corner areas of said internal rotor kinematically describe said internal lateral faces of said external rotor, said internal sealing corner areas of said external rotor kinematically describe said external peripheral faces of said internal rotor, and a meshing gear-like contact is maintained between said internal lateral faces of said external rotor and said lateral faces of said internal rotor, said internal rotor extending to the periphery of said external rotor at certain points during the relative rotation therebetween, with said recesses of said external rotor extending to the periphery of said external rotor to open radially outwardly thereof and moving past said inlet means and said outlet means of said casing;

said internal lateral faces of said external rotor are flat and are arranged parallel to one another in opposed facing relationship.

* * * * *